United States Patent [19]

Sawada et al.

[11] 4,246,009

[45] Jan. 20, 1981

[54] SMOKE FILTER MATERIAL AND USE THEREOF

[75] Inventors: Hideo Sawada, Osaka; Motoharu Kotani; Koji Sato, both of Sakai; Toichiro Izawa, Chiba; Ken-ichiro Sugimori, Tokyo; Akisato Katanosaka, Toyonaka, all of Japan

[73] Assignees: Daicel Ltd.; Goseikagaku Institute Ltd., both of Tokyo, Japan

[21] Appl. No.: 925,294

[22] Filed: Jul. 17, 1978

[30] Foreign Application Priority Data

Jul. 19, 1977 [JP] Japan ..... 52-85569

[51] Int. Cl.[3] ..... B01D 53/02

[52] U.S. Cl. ..... 53/74; 55/97; 55/316; 55/522; 55/387; 252/378 R; 131/202

[58] Field of Search ..... 55/74, 316, 97, 387, 55/524, 522, 92; 131/202, 203, 207; 252/441, 430, 378 R, 457; 106/DIG. 3, 73.1, 58; 210/502–504

[56] References Cited

U.S. PATENT DOCUMENTS

| | | | |
|---|---|---|---|
| 2,978,064 | 4/1961 | Deaver | 55/387 |
| 3,001,571 | 9/1961 | Hatch | 162/152 |
| 3,019,127 | 1/1962 | Czerwonka | 55/316 |
| 3,428,054 | 2/1969 | Scarabello et al. | 131/10.9 |
| 3,925,248 | 12/1975 | Moroni et al. | 55/387 |
| 3,936,383 | 2/1976 | Daimon et al. | 423/326 |
| 4,067,819 | 1/1978 | Daimon et al. | 252/378 R |

*Primary Examiner*—Bernard Nozick

[57] ABSTRACT

A smoke filter for removing injurious components from the smoke. Comprises a fiber matrix in conjunction with a water-swellable synthetic mica. The fiber matrix may be made of cellulose acetate, regenerated cellulose, or the like. The water-swellable synthetic mica is of the general formula $$W_{\frac{1}{3}\ to\ 1}(X,Y)_{2.5\ to\ 3}(Si_4O_{10})F_2$$

wherein W is Na or Li cation, and X and Y represent 6-coordinate ions, for example, Mg and Li. Suitable synthetic micas include Na-tetrasilicic mica, Na-taeniolite, Li-taeniolite, Na-hectorite, and Li-hectorite.

18 Claims, No Drawings

SMOKE FILTER MATERIAL AND USE THEREOF

BACKGROUND OF THE INVENTION

1. Field of the Invention

This invention relates to a smoke filter material, and more particularly, to a smoke filter material especially useful for tobacco products.

2. Description of the Prior Art

Generally, smoke, e.g., as produced by smoking cigarettes, cigars and pipe tobaccos, is made up of gaseous components together with minute liquid droplets and solid particles suspended therein. Contained in such tobacco smoke are some components which are considered to be hazardous to the smoker's health. Therefore, various kinds of smoke filters have been proposed and put to practical use in an effort to remove such components.

Commonly used materials for smoke filtering are fiber aggregates (hereinafter referred to as fiber matrices), and various adsorbents are generally used in combination therewith. Conventional filter materiais, however, have not been fully satisfactory, e.g., with respect to filtration efficiency, as well as other properties.

Smoke filter materials that previously have been used include fiber matrices, such as cellulose acetate or pulp fiber matrices. Also, activated carbon, zeolite, silica gel, ion exchange resin, etc., in granular form, have been used as adsorbents within the filter matrix. Many of these conventional adsorbents have a large active surface area and are gas adsorbents, but are disadvantageous in one or more respects. For example, activated carbon has the drawback that, during smoking, it emits the characteristic odor of active-carbon. Moreover, its adsorptive affinity for nicotine, tar and the like is low.

SUMMARY OF THE INVENTION

The present invention provides a smoke filter material having a superior capacity for removing injurious gaseous, liquid and solid components from smoke. It provides a smoke filter material that is especially efficient for tobacco smoke, with a high rate of removal of injurious components contained therein, especially nicotine and tar, as well as minute solid particles and acetaldehyde in the gaseous phase, yet without adversely affecting the flavor and taste of tobacco. In accordance with this invention, there is provided a smoke filter material which comprises a fiber matrix and a water-swellable synthetic mica.

DESCRIPTION OF THE PREFERRED EMBODIMENTS

The water-swellable synthetic mica to be used in the smoke filter material of this invention is a crystalline material with a stratified or multi-layer structure, and is of the following general formula:

$$W_{\frac{1}{3}} \text{ to } 1^{(X,Y)}2.5 \text{ to } 3^{(Si}4^{O}10^{)F}2$$

wherein W is a Na or Li cation, and X and Y represent 6-coordinate ions, for example, Mg and Li. The unit layer for this stratified structure is a three-layer lattice or silicate tetrahedron-octahedron, with the 6-coordinate ion at the center silicate tetrahedron, and the unit layer are superimposed in the direction of the c-axis of the crystal. Between the unit layers there are coordinating cations ($Na^+$ or $Li^+$) as interlayer ions, which neutrize the unbalanced charge in the three-layer lattice.

For a further description of the 6-coordinate ions, reference may be had to the following publications: Daniels et al, "Crystallization of Tetrasilicic Fluormica Glass", *J. Am. Ceram. Soc.*, Vol. 58, pp. 217–221; Hatch et al, "Synthetic Mica Investigations, IX: Review of Progress From 1947 To 1955, Report of Investigations 5337", U.S. Bureau of Mines, pp. 53–55, 58–59 (June, 1957); and Shell et al, "Fluorine Micas", Bulletin 647, pp. 110–122, U.S. Bureau of Mines (1969); the contents of each of these publications being incorporated herein by reference.

Synthetic micas of the foregoing type may be prepared as follows. The starting materials, comprising silica ($SiO_2$), magnesia (MgO), and a suitable fluoride (e.g., NaF, LiF, $MgF_2$, $Na_2SiF_6$, $Li_2SiF_6$), are admixed in a molar ratio corresponding to the chemical composition of the desired synthetic mica. The mixture is melted, as by heating to 1300° to 1500° C., desirably by means of an electric internal-resistance melting technique. The molten mass is then cooled to give a crystalline mass of the desired synthetic mica.

Examples of suitable synthetic micas are as follows. The interlayer ions of these synthetic micas may be substituted.

Na-tetrasilicic mica $NaMg_{2.5}(Si_4O_{10})F_2$
Na-taeniolite $NaMg_2Li(SI_4O_{10})F_2$
Li-Taeniolite $LiMg_2Li(Si_4O_{10})F_2$
Na-hectorite $Na_{\frac{1}{3}}Mg_{2\frac{2}{3}}Li_{\frac{1}{3}}(Si_4O_{10})F_2$
Li-hectorite $Li_{\frac{1}{3}}Mg_{2\frac{2}{3}}Li_{166}(Si_4O_{10})F_2$ Synthetic micas of the foregoing type may be used either alone or in admixture with one another.

As is well known, the interlayer bonds of natural mica crystals are weak, so that they readily cleave into flaky powders. Synthetic micas also exhibit this property. However, whereas in natural micas, for example, phlogopite $KMg_3(AlSi_3O_{10})(OH)_2$
muscovite $KAl_2(AlSi_3O_{10})(OH)_2$
fluorophlogopite $KMg_3(AlSi_2O_{10})F_2$ the tetrahedral positions take the form of $AlSi_3$, those of synthetic micas are in the form of $Si_4$. The $AlSi_3$ type micas are not water-swellable. By contrast the $Si_4$ type of synthetic micas, when immersed in water, take in a great number of water molecules between the layers and hence, become hydrated and swell. Finally the interlayer bonds are cleaved, resulting in the formation of flaky elements having a thickness not more than 50 Å (Angstrom units) and a diameter of 1 to 5μ (microns). This is due to the fact that in the $Si_4$ type of synthetic micas, the interlayer bonds are much weaker, the interlayer ions $Na^+$ and $Li^+$ are of small ionic radii, and there is high hydration energy. The flaky elements form a hydrated colloid in water.

The above mentioned flaky elements or particles have the following desirable properties for a smoke filter material:

(1) Ion exchange capability:

Synthetic micas show ion exchange properties in water. For example, in the case of the $W_{\frac{1}{3}}$ type, they posses a cation exchange capacity (C.E.C.) of 100 to 110 milliequivalents per 100 grams of mica, and in the case of the $W_1$ type, the capacity is 230 to 250 milliequivalents per 100 grams of mica. This is because the interlayer bonding of the interlayer ions ($Na^+$, $Li^+$) and the oxygen atoms of silicate tetrahedrons is in the manner of $O_6 \ldots W \ldots O_6$ 12-coordination, and the electrostatic bonds are weak. The synethic micas, in aqueous solutions of electrolytes such as salts from which cations are dissociated, can exchange such ions as $(H_3O)^+$, $K^+$, $NH_4^+$, $Ca^{++}$, $Mg^{++}$, $Sr^{++}$, $Ba^{++}$, $Cu^{++}$, $Fe^{+++}$, $Bi^{+++}$, $Ti^{++++}$ and $Zr^{+++++}$, in accordance with the order in the Hofmeister's series.

Synthetic micas are further activated by cationic species in such ion exchange. In particular, the synthetic micas in which the interlayer ions are $(H_3O)^+$ and $Al^{+++}$ can behave as solid acids to form salts with organic and inorganic anionic compounds, and those in which the interlayer ions are $NH_4^+$, $Ca^{++}$, $Mg^{++}$, or the like, have activity as adsorption catalysts for various compounds. Such properties are especially useful for the present invention.

(2) The ability of forming complexes with metal hydroxides:

Synthetic micas can substitute hydroxy-form cations of metal hydroxides $[M(OH)_{6-x}(H_2O)_x]$ for their interlayer ions ($Na^+$, $Li^+$), whereby said cations are allowed to coordinate in the interlayer area. Thus, for example, Na-tetrasilicic mica and aluminum hydroxide give hydroxyaluminum-type tetrasilicic mica $[Al_2(OH)_5(H_2O)]Mg_{2.5}Si_4O_{10}F_2$. This mica can fix organic compounds within itself through the action of its aluminol group (Al-OH).

(3) The ability of forming complexes with organic compounds:

Synthetic micas can draw polar organic compounds in between their crystal layers to form coordinative interlayer complexes. Thus, the polar organic compounds are drawn in between the layers by the action of Coulomb's force, mainly due to the negative charge of oxygen atoms exposed on the interlayer surfaces.

When synthetic micas are in the dry condition, polar organic substances in smoke or gaseous phase are adsorbed between the layers of synthetic micas owing to the above mentioned reaction.

The fiber matrix to be used in the filter material of the invention may be in the form of tow, web, or any other suitable shape, and may be made of cellulose acetate fiber, regenerated cellulose (rayon) fiber, pulp, or other fiber.

In the filter material of the invention, the ratio of the synthetic mica to the fiber matrix may very widely, depending upon the particular purpose. Generally, however, it is prefered that the synthetic mica be used in an amount corresponding to 10 to 200 percent by weight based on the fiber matrix.

The size and shape of the synthetic mica particles may also vary widely, according to the particular desired end use of the fiber material. Generally, however, particle sizes 4 to 100 mesh are desirable, with 30 to 50 mesh being preferred. Likewise, in most instances, granular particle shapes are preferred.

In the filter material of the invention, the synthetic mica may be distributed in the fiber matrix uniformly or with an arbitrary density distribution. For instance, at least one layer or bed of the synthetic mica and at least one layer or bed of the fiber matrix may be connected in an arbitrary order.

The fiber material of the invention can be prepared by conventional filter-making techniques. Thus, a smoke filter material according to the invention can be produced in the following manner.

Granules of a synthetic mica are distributed in a fiber matrix and filter tips are made. These filter tips are each connected to a conventional filter tip made of cellulose acetate fiber to give dual filter tips. Thus, filter plugs are formed on a conventional filter making machine, while a plasticizer is added and a synthetic mica powder is added by using a vibrating feeder or the like.

In another embodiment, a synthetic mica in powder form is packed in a paper cylinder having a 1 to 5 mm height. The cylinder is then connected to a cigarette body, and a conventional filter tip made from cellulose acetate fiber, which forms a drawing tip portion, is further attached to the free end of the said cylinder, to form a dual filter.

In yet another embodiment, a triple filter may be produced by interposing a synthetic mica layer or bed between two filter tips comprising cellulose acetate fiber.

The filter material of the invention may either be connected directly to a cigarette body as mentioned above, or be placed in a holder for cigarettes or cigars or in a pipe body. Where the smoke filter material of the invention is used for tobacco, it is preferred that 3 to 150 mg of a synthetic mica be used per cigarette.

The advantages that the smoke filter material of the invention may be summarized as follows:

1. By virtue of the synthetic mica, poisonous gases in smoke, such as acetaldehyde can be selectively removed, and filtration efficiency can be improved for nicotine, tar and total particulate matter (TPM).
2. Synthetic micas wherein the interlayer ions are $H^+$ and $(H_3O)^+$ do not adversely affect the smoking quality or tobacco flavor.
3. Synthetic micas are pleasing to the eye. Their acute oral toxicity is virtually negligible. Consequently the resulting filter material is sanitary and attractive in appearance.
4. Wear and abrasion of the blade used to cut the filter material to a desired size is less than in the case where activated carbon is used.
5. Higher filtration efficiency can be attained without increasing the pressure drop (draw resistance).

The following examples will further illustrate the invention. All parts are by weight unless otherwise stated. Methods of measuring in the examples are as follows:

Pressure drop: This was indicated by the reading on the scale of a U-tube water column manometer when air was drawn through a filter connected with the manometer in a parallel fashion by a vacuum pump, and the rate of flow of the air passing through the filter reached 17.5 ml per second.

Filtration efficiency for tar, nicotine and TPM:

Cigarettes were smoked mechanically, using an automatic smoking machine which took a puff of 35 ml volume and 2 seconds duration every minute while maintaining a rate of flow of 17.5 ml per second, until the length of burnt cigarette portion reached 50 mm. Tar and nicotine fractions in the smoke that had passed through the filter tip were collected by means of a glass fiber filter (Cambridge filter). TPM and tar were determined gravimetrically, while nicotine was determined by ultraviolet spectrophotometric technique. The filtration efficiency was calculated according to the formula:

$$\text{\% Filtration efficiency} = \frac{\text{Amount collected by tobacco}}{\text{Amount collected by Cambridge filter} + \text{Amount collected by tobacco filter}} \times 100$$

EXAMPLE 1

A tow (43,000 deniers) of Y-section cellulose acetate filament (4 deniers) was bloomed. 70 to 80 parts by weight of a synthetic mica in which the interlayer ions were $H^+$ or $(H_3O)^+$ (namely the roton or hydronium ion form of tetrasilicic mica having a 42–60 mesh particle size) per 100 parts by weight of the tow, were added. The whole was formed into filter plugs 90 mm long and 24.7 mm in circumference. These plugs were cut into 10 mm filter tips. Each filter tip contained 40 to 50 mg of the synthetic mica.

Filter tips comprising cellulose acetate filter only were prepared by repeating the above procedure, but without the use of the above synthetic mica.

Each of the above two types of filter tips was connected to the other. The resulting 20 mm dual filter was attached to the body of a commerical cigarette ("Hi-Lite" trademark) with its original filter portion removed in such a manner that the synthetic mica containing tip was in contact with the cigarette body.

The resulting cigarette with the synthetic mica containing filter was smoked on the automatic smoking machine until the burning length reached 55 mm, and filtration efficiencies for tar, nicotine and TPM were determined. The results are given in Table 1.

When compared with the case where activated carbon was added instead of the synthetic mica, the synthetic mica containing filters were superior in the filtration efficiencies in spite of their low pressure drop.

TABLE 1

| Sample No. | Additive | Particle size (mesh) | Amount added (mg/10mm tip) | Pressure drop (mm $H_2O$) | Filtration efficiency (%) TPM | Tar | Nicotine |
|---|---|---|---|---|---|---|---|
| 1 | $H^+$ form of tetrasilicic mica | 42–60 | 46 | 75 | 57 | 49 | 42 |
| 2 | $H_3O^+$ form of tetrasilicic mica | 28–42 | 47 | 75 | 59 | 47 | 41 |
| Comparative sample | Activated carbon | 40–80 | 44 | 84 | 54 | 43 | 38 |

With regard to Sample No. 1, gas-chromatographic analysis of the gaseous components after passing through the filter showed that the amount of acetaldehyde was relatively small in comparison with that of isoproprene in the main smoke stream. This means that polar molecules such as acetaldehyde were selectively adsorbed by the synthetic mica. A tobacco-smoking sensory test showed that Samples No. 1 and 2 did not have the so-called charcoal odor and offered a mild smoke.

EXAMPLE 2

Filter plugs 90 mm long and 24.7 mm in circumference were prepared on a conventional filter-making machine by using the same cellulose acetate tow as in Example 1 and adding 60 parts by weight of several synthetic micas with different interlayer ions per 100 parts by weight of the acetate tow, by the same method as in Example 1. The plugs were severed into 17 mm tips. The tip was attached to the body of a commerical cigarette ("Hi-Lite") with its original filter portion removed.

The resulting cigarette with the synthetic mica containing filters were smoked on the automatic smoking machine until the length of the burnt portion reached 50 mm. For purposes of comparison, a cigarette with a conventional filter of cellulose acetate filter was also smoked in the same manner. The results of filtration efficiency determinations for tar and nicotine are given in Table 2.

TABLE 2

| Sample No. | Synthetic mica | Particle size (mesh) | Pressure drop (mm $H_2O$) | Filtration efficiency (%) Tar | Nicotine |
|---|---|---|---|---|---|
| 3 | Hydroxyaluminum tetrasilicic mica | 40–80 | 50 | 46 | 48 |
| 4 | Aluminim type tetrasilicic mica | 40–80 | 49 | 40 | 36 |
| 5 | $H^+$ form of tetrasilicic mica | 40–80 | 50 | 40 | 38 |
| Conventional filter (Comparative sample) | — | — | 49 | 36 | 33 |

Each of of the synthetic mica containing filters, Samples Nos. 3 to 5, was superior in its filtration efficiency to the conventional filter, which comprised cellulose acetate fiber alone, yet each maintained the pressure drop at essentially the same level as that of the conventional filter.

Variations can, of course, be made without departing from the spirit and scope of the invention.

Having thus described the invention what is desired to be secured by Letters Patent and hereby claimed is:

1. A method of removing injurous components from smoke containing said components comprising passing said smoke through a filter material comprising a fiber matrix in combination with a water-swellable synthetic mica, wherein said synthetic mica is a product obtained from a synthetic mica of the formula $$W_{\frac{1}{3}\text{ to }1}(X,Y)_{2.5\text{ to }3}(Si_4O_{10})F_2$$

wherein W represents interlayer ions and is Na- or Li-cations and X and Y represent 6 coordinate ions; by substitution of the interlayer ions.

2. The method of claim 1 wherein said interlayer ions are substituted by cations selected from the group consisting of $(H_3O)+$, $K+$, $NH_4+$, $Ca++$, $Mg++$, $Sr++$, $Ba++$, $Cu++$, $Fe+++$, $Bi+++$, $Ti++++$, $Zr++++$, $Al+++$, and hydroxy-formed cations of metal hydroxide.

3. The method of claim 1 wherein said synthetic mica $H+$-hectorite, $H_2O+$-hectorite, $Al^{3+}$hectorite, $Al_2(OH)_5H_2O+$-hectorite.

4. The method of claim 1 wherein synthetic mica has a size of 4 to 100 mesh.

5. The method of claim 1 wherein said synthetic mica is dispersed in said fiber matrix.

6. The method of claim 1 wherein at least one layer of said synthetic mica and at least one layer of said fiber matrix are in surface contact with one another.

7. The method of claim 1 wherein X is the Mg ion and Y is the Li ion.

8. The method of claim 1 wherein said synthetic mica is present in an amount of from about 10 to 200 percent by weight of said fiber matrix.

9. The method of claim 13 wherein said synthetic mica is present in an amount of from about 10 to 100 percent by weight of said fiber matrix.

10. A smoke filter material for removing injurous components from smoke comprising a fiber matrix in combination with a water-swellable synthetic mica, wherein said synthetic mica is a product obtained from a synthetic mica of the formula $$W_{\frac{1}{3}\text{to }1}(X,Y)_{2.5\text{ to }3}(Si_4O_{10})F_2$$

wherein W represent the interlayer ions and is Na- or Li-cations, and X and Y represent 6-coordinate ion; by substitution of the interlayer ions.

11. The filter material of claim 10 wherein said synthetic mica has a size of 4 to 100 mesh.

12. The filter material of claim 10 wherein said synthetic mica is dispersed in said fiber matrix.

13. The filter material of claim 10 wherein at least one layer of said synthetic mica and at least one layer of said fiber matrix are in surface contact with one another.

14. The filter material of claim 10 wherein X is the Mg ion and Y is the Li ion.

15. The smoke filter material of claim 1 wherein said interlayer ions are substituted by cation selected from the group consisting of $(H_3O)+$, $K+$, $NH_4+$, $Ca++$, $Mg++$, $Sr++$, $Ba++$, $Cu++$, $Fe+++$, $Bi+++$, $Ti++++$, $Zr++++$, $Al+++$, and hydroxy-formed cation of metal hydroxide.

16. The filter material of claim 10 wherein said synthetic mica is $H+$-hectorite $H_2O+$-hectorite, $Al^{3+}$-hectorite, $Al_2(OH)_5H_2O+$-hectorite.

17. The filter material of claim 10 wherein said synthetic mica is present in an amount of from about 10 to 200 percent by weight of said fiber matrix.

18. The filter material of claim 4 wherein said synthetic mica is present in an amount of from about 10 to 100 percent by weight of said fiber matrix.

* * * * *